US005915935A

United States Patent [19]

Weldle et al.

[11] Patent Number: 5,915,935

[45] Date of Patent: Jun. 29, 1999

[54] COCKING TRIGGER DEVICE

[75] Inventors: Helmut Weldle, Oberndorf-Beffendorf; Rolf Knöpfle, Alpirsbach, both of Germany

[73] Assignee: Heckler & Koch GmbH, Oberndorf/Neckar, Germany

[21] Appl. No.: 09/124,824

[22] Filed: Jul. 29, 1998

[30] Foreign Application Priority Data

Jul. 30, 1997 [DE] Germany ..... 197 32 857

[51] Int. Cl.[6] ..... F41A 3/00

[52] U.S. Cl. ..... 42/69.03; 42/45; 42/69.01; 42/65

[58] Field of Search ..... 42/69.03, 45, 69.01, 42/65; 89/154

[56] References Cited

U.S. PATENT DOCUMENTS

| | | | |
|---|---|---|---|
| 3,726,040 | 4/1973 | Cranston | 42/69 R |
| 4,028,836 | 6/1977 | Keppeler | 42/69 B |
| 4,282,795 | 8/1981 | Beretta | 89/148 |
| 4,392,319 | 7/1983 | Ottolini | 42/69 B |
| 4,589,377 | 5/1986 | Smith | 89/148 |
| 4,706,401 | 11/1987 | Nielsen | 42/69.03 |
| 5,216,195 | 6/1993 | Tuma | 89/147 |

FOREIGN PATENT DOCUMENTS

| | | | |
|---|---|---|---|
| 0 013 583 B1 | 1/1980 | European Pat. Off. | 42/69.03 |
| 0 154 356 | 9/1985 | European Pat. Off. | 42/69.03 |
| WO 82/03910 | 11/1982 | WIPO | 42/69.03 |

*Primary Examiner*—Charles T. Jordan
*Assistant Examiner*—Meena Chelliah
*Attorney, Agent, or Firm*—Marshall, O'Toole, Gerstein, Murray & Borun

[57] ABSTRACT

A cocking trigger mechanism is disclosed. The cocking trigger mechanism includes a hammer element that is moveable between a front position and a rear position, and a drive part that is moveable between an uncocked position and a cocked position. The drive part is arranged to entrain the hammer element during its movement into the uncocked position. A striker spring biases the drive part into the uncocked position. A trigger causes movement of the drive part against the force of the striker spring from the uncocked position to the cocked position and actuates its release. When the drive part is moved independently of the trigger into the cocked position, it is held in this position until subsequent operation of the trigger. The hammer element is connected to a return spring that forces it into a rest position that is situated near its front position as long as the trigger is not operated so that it always assumes a defined position.

24 Claims, 5 Drawing Sheets

COCKING TRIGGER DEVICE

FIELD OF THE INVENTION

The invention relates generally to firearms, and, more particularly, to a cocking trigger device for use in a firearm.

BACKGROUND OF THE INVENTION

Cocking trigger mechanisms which are specifically designed for automatic pistols are known from the Daewoo DP 51 C automatic pistol. In contrast to an ordinary pistol in which the hammer element and the drive part together form a single component, namely, the hammer, the Daewoo DP 51 C pistol has no permanent fixed connection between its drive part and its hammer element. The hammer element is easily braked by friction, but is otherwise mounted to pivot freely in the pistol stock. The hammer element, which is designed as a cocking lever and provided with a thumb rest for manual cocking, is forced forward by the drive part when the weapon is fired.

This known pistol can be used like any double-action pistol. Specifically, when the drive part is uncocked and the hammer element is situated in its rest position (i.e., when the pistol is in its fully uncocked position), the hammer element and drive part can be moved backward together by applying a relatively large force to the trigger. When the trigger is pulled rearwardly a sufficient distance, the hammer element and the drive part retract (i.e., move forward) such that the hammer element strikes the firing pin and a shot is fired. When the hammer element and the uncocked drive part are moved to the rear by means of the handle of the hammer element or by the breech of the loaded pistol, the hammer element remains in its rear position and the drive part remains in its cocked position as a single cock until the trigger is released. Compared to the fully uncocked position discussed above, a relatively low amount of force is required to pull the trigger when the weapon is in this fully cocked position.

When the weapon is in its fully cocked position, it is possible to push the hammer element forward into its rest position while the drive part remains in its cocked position without firing a shot. This position of the trigger mechanism can be referred to as the "increased readiness position". Since the hammer element is situated in its rest position when the weapon is in its increased readiness position, the hammer element does not protrude from the weapon. As a result, the pistol can be kept in a pocket or shoulder holster without fear that the hammer element will accidentally catch on an external element (for example, on the cover of the pocket or on the material of a jacket) when the pistol is pulled. When the weapon is in the increased readiness position, a relatively low force is required to fire the pistol. Specifically, when the weapon is in the increased readiness position, the force to cock the striker spring does not need to be applied via the trigger to fire the pistol. Instead, only the frictional resistance of the hammer element, which is pivoted rearward by itself since the drive part is already secured in its cocked position, must be overcome to reach the pressure point.

Whereas, in the fully cocked position (wherein the hammer element is positioned close to its rear position) a limited force exerted on the trigger is sufficient to fire the shot, in the "increased readiness position" the frictional force of the hammer element (i.e., the force required to draw the hammer element rearward from its at rest position) must be overcome to fire the pistol. As a result, the danger of unintentional firing a shot when the pistol is in its increased readiness position is reduced as compared to the fully cocked position.

However, the reduced danger associated with the increased readiness position of the Daewoo DP 51 C pistol can be somewhat illusory. For example, it is easily possible for the hammer element to approach its rear end position if the handle of the hammer element catches on clothing, on a branch, or on some other obstruction, so that, while the shooter is relying on the "increased readiness position", the fully cocked position is actually present. The danger of unintentionally firing a shot, which is supposed to be reduced in the increased readiness position, is then quite real. Moreover, the frictional force required to move the hammer element from its rest position to its rear position is highly subject to the condition of the weapon. Wear, oil with high lubricating effect, and/or rust film can drastically alter this frictional force under some circumstances. Dust, fine sand, frost which thickens the weapon lubricant, etc. can also have such an effect. Finally, operation of the Daewoo DP 51 C is complicated because of the three possible states of the trigger mechanism. This is disadvantageous because the simplest possible operation is desired in a military weapon. Simple design of the cocking trigger mechanism is, however, advantageous.

To achieve a comparable "increased readiness position" it is proposed in EP Patents 0,077,790 and 0,154,356 that the striker spring should only be partially cocked during loading of an automatic pistol, as is also the case in the Austrian calvary pistol Roth-Steyr model 1907. As a result, the shooter is required to fully cock the striker spring during each shot via the trigger. However, it is additionally proposed in the aforementioned patents that a tension spring counteract the striker spring so that the force required for final cocking of the striker spring is partially applied by the tension spring. With a fully cocked striker spring, the tension spring is disconnected and the firing pin can retract.

These pistols are disadvantageous because their complicated decoupling mechanisms are prone to soiling and corrosion. In addition, these known pistols have the shortcoming that they are continuously cocked, even if only partly. In an unfavorable case only a weak impact on the firing pin can be sufficient to fire a cartridge, should the other safety precautions fail. Another shortcoming of these pistols is the fact that breech movement is always required to cock the firing pin into the partially cocked position. For example, if striking of the firing pin is impeded by water that has penetrated the weapon or too much oil in the weapon (in wet pistols or pistols that are too heavily oiled), then failure of a nondefective cartridge can occur. If the shooter has only one free hand, (for example, because he is bracing himself with the other hand), then he cannot reload the pistol, so that it fails. In contrast, if a cocking trigger mechanism were present, he could simply retract it again, which in the described case would fire the cartridge with high probability and would return the pistol to full readiness.

On the other hand, pistols of the foregoing type are advantageous in that their trigger resistance can be adjusted by adjusting the tension spring, and in that the same type of operation is always present during shooting (i.e., they are relatively simple to operate).

SUMMARY OF THE INVENTION

In accordance with an aspect of the invention, a cocking trigger mechanism is provided for use with a firearm. The cocking trigger mechanism includes a hammer element having a front position, a rear position, and a rest position. The rest position is disposed between the front position and the rear position. The hammer element is movable between the front position and the rear position and is adapted to strike an object to fire a shot when it enters the front position. The cocking trigger mechanism is also provided with a drive part having an uncocked position and a cocked position. The drive part is moveable between the uncocked and cocked positions and is located to entrain the hammer element when it moves from the cocked position to the uncocked position. Additionally, the cocking trigger mechanism includes a striker spring biasing the drive part towards the uncocked position, and a trigger in operative engagement with the hammer element for moving the hammer element towards its rear position. If the drive part is in the uncocked position when the hammer element is moved, the hammer element moves the drive part against the force of the striker spring towards the cocked position. The cocking trigger mechanism is further provided with a return spring biasing the hammer element towards the rest position whereby the hammer element assumes the rest position in the absence of a counteracting force being applied thereto. The cocking trigger mechanism also includes a first safety lever for operatively engaging the drive part to temporarily secure the drive part in the cocked position when the drive part is moved from the uncocked position to the cocked position independently of the trigger.

In some embodiments, the object to be struck by the hammer element comprises a firing pin. In other embodiments, the object to be struck by the hammer element comprises an ignition area of a cartridge.

Preferably, the rest position is a default position of the hammer element. Also preferably, unless the trigger is operated, when the hammer element is released from the rear position, it returns to the rest position without entering the front position.

In the preferred embodiments, the drive part is separated from the hammer element when the drive part is in the cocked position and the hammer element is in the rest position.

In some embodiments, the cocking trigger mechanism is further provided with a second safety lever which operatively engages the hammer element to define the rest position. In some such embodiments, unless the trigger is operated, the second safety lever prevents the hammer element from entering the front position. In some embodiments, the hammer element includes a safety catch which cooperates with a detent formed by the second safety lever to secure the hammer element in the rest position. In some embodiments, the second safety lever is operatively coupled to the trigger so that operation of the trigger moves the second safety lever to permit the hammer element to enter the front position. In some embodiments, the second safety lever has a first position in which it prevents the hammer element from entering the front position and a second position wherein the hammer element can enter the front position. In such embodiments, the second safety lever is operatively coupled to the trigger such that operation of the trigger moves the second safety lever from the first position to the second position.

In some embodiments, the return spring comprises a trigger spring, and pulling the trigger moves the hammer element toward the rear position.

In some embodiments, the first safety lever is operatively coupled to the trigger such that movement of the trigger disengages the first safety lever from the drive part to permit movement of the drive part from the cocked position to the uncocked position under the force of the striker spring.

In some embodiments, the cocking trigger mechanism is further provided with a trigger rod in operative engagement with the hammer element and the first safety lever. In some such embodiments, the trigger rod is disposed to release the drive part from the first safety lever when the hammer element enters the rear position, and/or the trigger rod is disposed to move the drive part into the cocked position when the hammer element is moved towards the rear position. In any of the foregoing embodiments, the hammer element may define a recess, and the trigger rod may be disposed within the recess such that each position of the trigger rod is coordinated with a corresponding position of the hammer element.

In some embodiments, the hammer element includes a handle for facilitating manual movement of the hammer element towards the rest position.

In some embodiments, the hammer element is completely disposed within a housing associated with the firearm to prevent contact therewith.

In some embodiments, the cocking trigger mechanism is further provided with a stop positioned to prevent the drive part from contacting the hammer element when the hammer element is in the rest position and the trigger is in an unfired position. In some such embodiments, the stop comprises part of the first safety lever.

In accordance with another aspect of the invention, a cocking trigger mechanism for use with a firearm is provided. The cocking trigger mechanism includes a hammer element disposed for movement between a front position, a rear position and a rest position. It also includes a return spring biasing the hammer element into the rest position, and a drive part having an uncocked position and a cocked position. The drive part is located to entrain the hammer element when it moves from the cocked position to the uncocked position. The cocking trigger mechanism is further provided with a striker spring biasing the drive part towards the uncocked position; a first safety lever for operatively engaging the drive part to selectively temporarily secure the drive part in the cocked position; and a second safety lever for operatively engaging the hammer element to selectively temporarily secure the hammer element in the rest position. Additionally, the cocking trigger mechanism includes a trigger in operative engagement with the hammer element for moving the hammer element towards its rear position. The cocking trigger mechanism has: (1) a secured uncocked position wherein the hammer element is secured in one of the front and rest positions and the drive part is secured in the uncocked position; (2) a secured increased readiness position wherein the hammer element is secured in the rest position and the drive part is secured in the cocked position; and (3) an unsecured fully cocked position wherein the drive part is secured in the cocked position and the hammer element is temporarily secured in the rear position by application of an external force.

In some embodiments, the hammer element includes a handle and the external force is manually applied to the handle, and/or the external force is manually applied to the hammer element via the trigger.

Other features and advantages are inherent in the apparatus claimed and disclosed or will become apparent to those skilled in the art from the following detailed description and its accompanying drawings.

DESCRIPTION OF THE PREFERRED EMBODIMENTS

Figure 1:
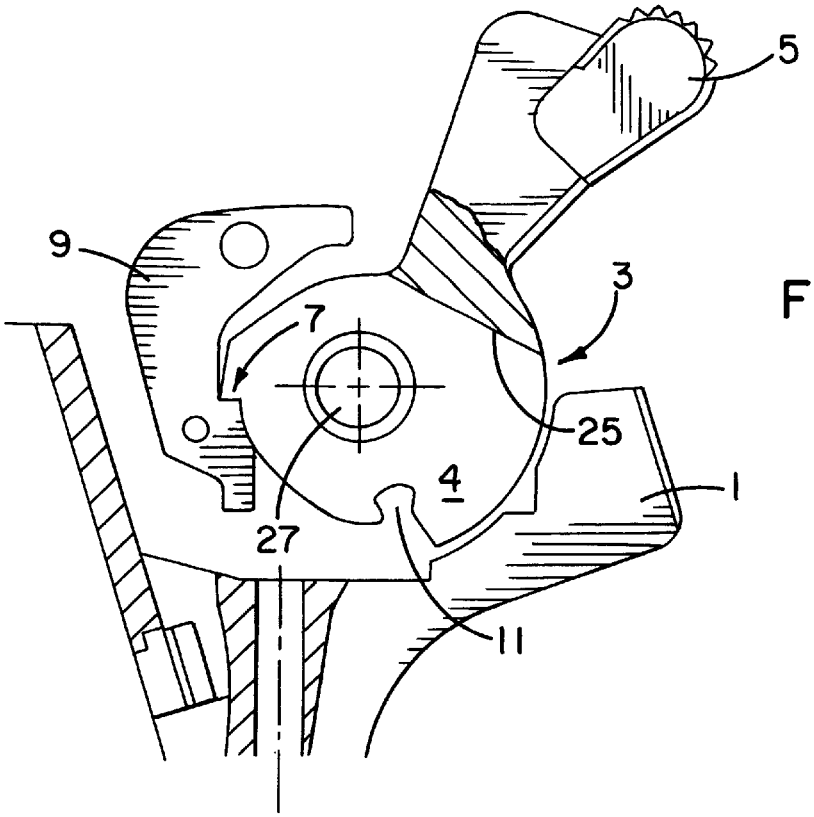
FIG. 1 is a schematic illustration of the rear section of a pistol stock employing a cocking trigger mechanism constructed in accordance with the teachings of the instant invention and showing the hammer element of the cocking trigger mechanism engaged with the safety lever in the rest position.

Throughout this document, positional designations such as "forward", "top" or the like refer to the position the trigger mechanism assumes when the weapon containing the mechanism is in a normal, substantially horizontal firing position. Under this convention, "forward" points in the direction of shooting; "forward" is equivalent to left in the drawings; and "top" is equivalent to "top" in the drawings.

The same reference numbers are used throughout the following discussion and in the appended drawings to refer to the same parts or elements.

Figure 3:
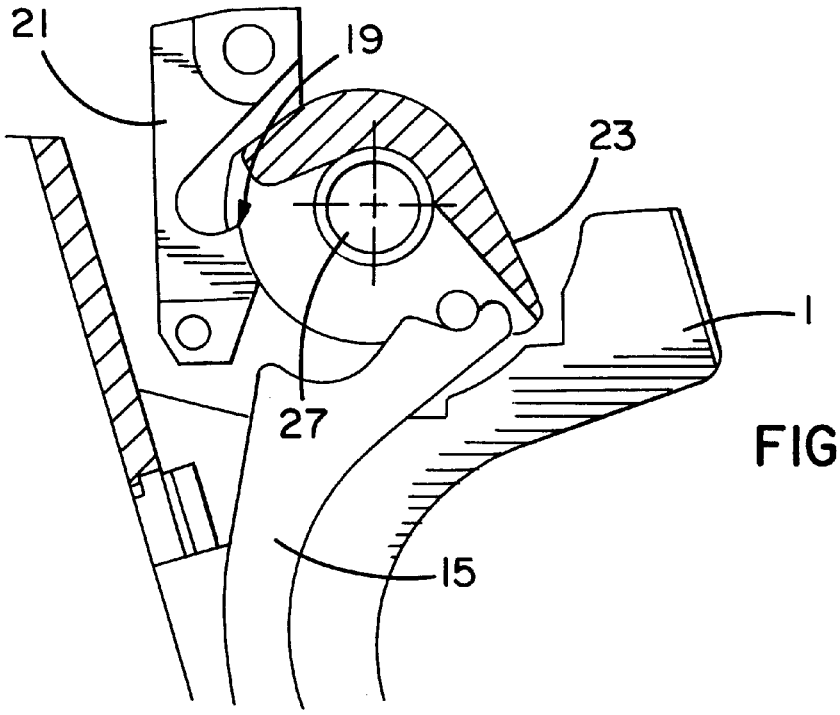
FIG. 3 is a view similar to FIG. 1, but showing the drive part in a cocked position and interacting with the locking lever and the spring rod.
Figure 4:
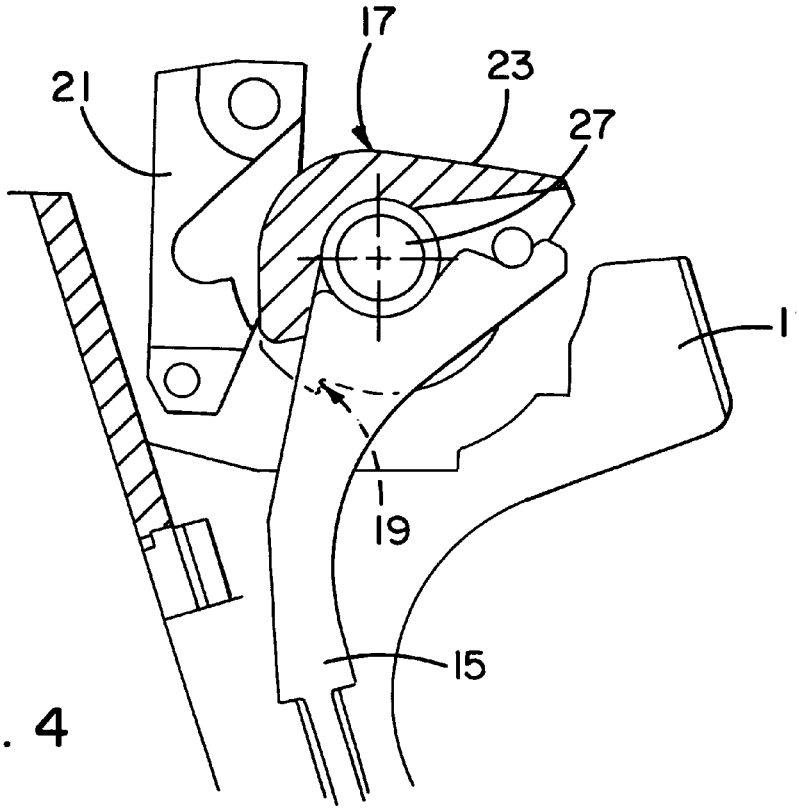
FIG. 4 is a view similar to FIG. 3, but showing the drive part in an uncocked position.
Figure 7:
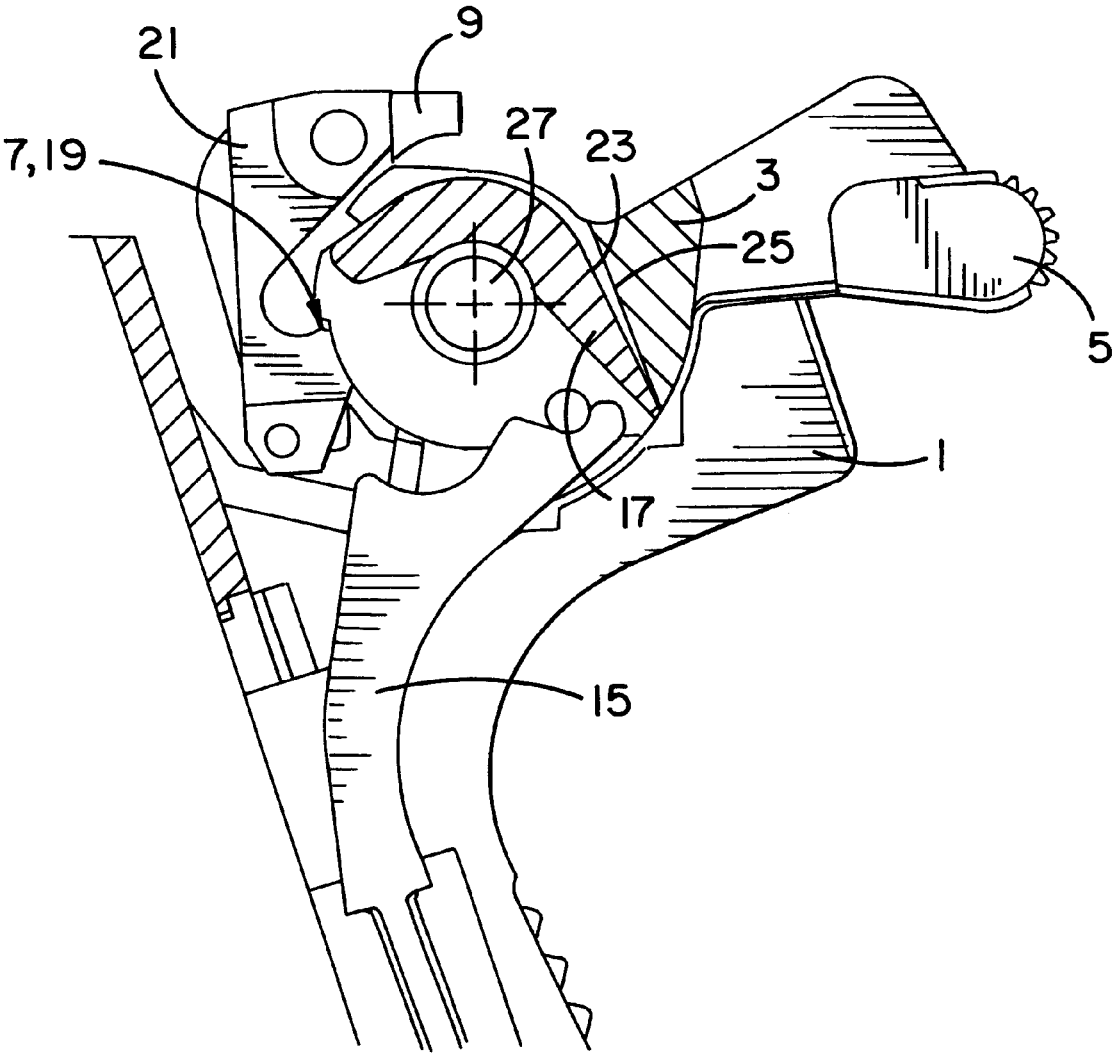
FIG. 7 is a view similar to FIG. 1, but showing the hammer element and the drive part immediately before release.

The rear section of a pistol stock 1 employing a cocking trigger mechanism constructed in accordance with the teachings of the invention is schematically illustrated in FIG. 1. The pistol stock 1 is intersected transversely by an axis 27. A hammer element 3 and a drive part 17 are pivotably mounted on the axis 27. As discussed below, the hammer element 3 has a front position (FIG. 2), a rest position (FIG. 1), and a rear position (FIG. 7). As also discussed below, the drive part 17 has a cocked position (FIG. 3) and an uncocked position (FIG. 4). Together these elements defines three states for the cocking trigger mechanism, namely, (1) a secured uncocked position wherein the hammer element 3 is secured in either the front position or the rest position and the drive part 17 is secured in the uncocked position; (2) a secured, increased readiness position wherein the hammer element 3 is secured in the rest position and the drive part 17 is secured in the cocked position; and (3) an unsecured, fully cocked position wherein the drive part 17 is secured in the cocked position and the hammer element 3 is temporarily secured in the rear position by application of an external force (e.g., by the thumb of a shooter or by a nearly completely pulled trigger).

Figure 6:
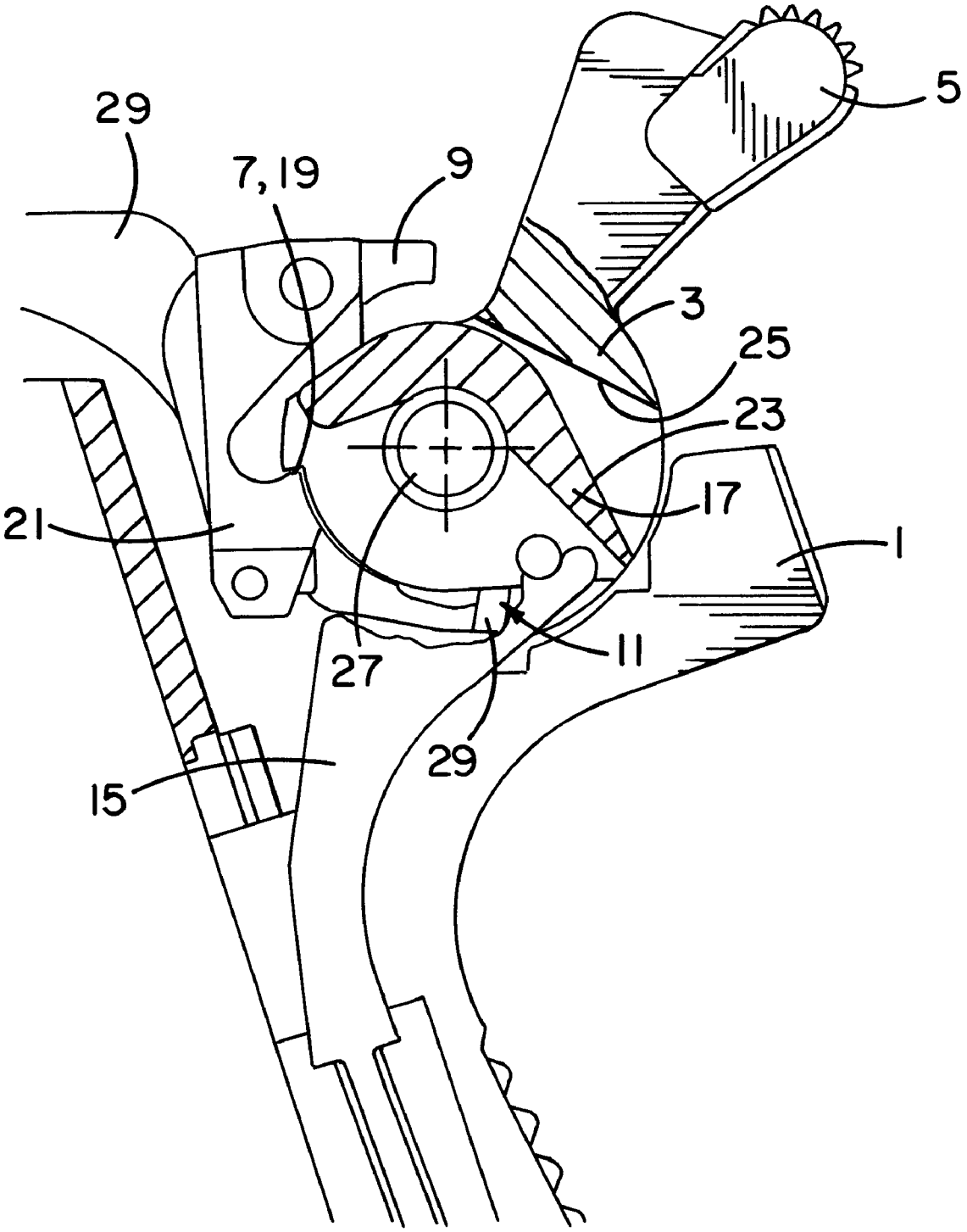
FIG. 6 is a view similar to FIG. 1, but showing the hammer element in the position of FIG. 1 and the drive part in the position of FIG. 3.

The part of the hammer element 3 closest to the axis 27 defines a recess 4. The recess 4 extends from the bottom of the hammer element 3 upwards in the longitudinal direction of the pistol stock 1 until it reaches a countersurface 25. The drive part 17 is disposed in the recess 4. The drive part 17 has a support surface 23. When the drive part 17 is pivoted counterclockwise around the axis 27, the support surface 23 abuts against the countersurface 25 such that the drive part 17 entrains the hammer element 3 as the drive part moves from its cocked position to its uncocked position. As shown in FIG. 6, the support surface 23 and the countersurface 25 are not always in contact. For example, the support surface 23 does not contact the countersurface 25 when the hammer element 3 is in its rest position and the drive part 17 is in its cocked position.

Figure 2:
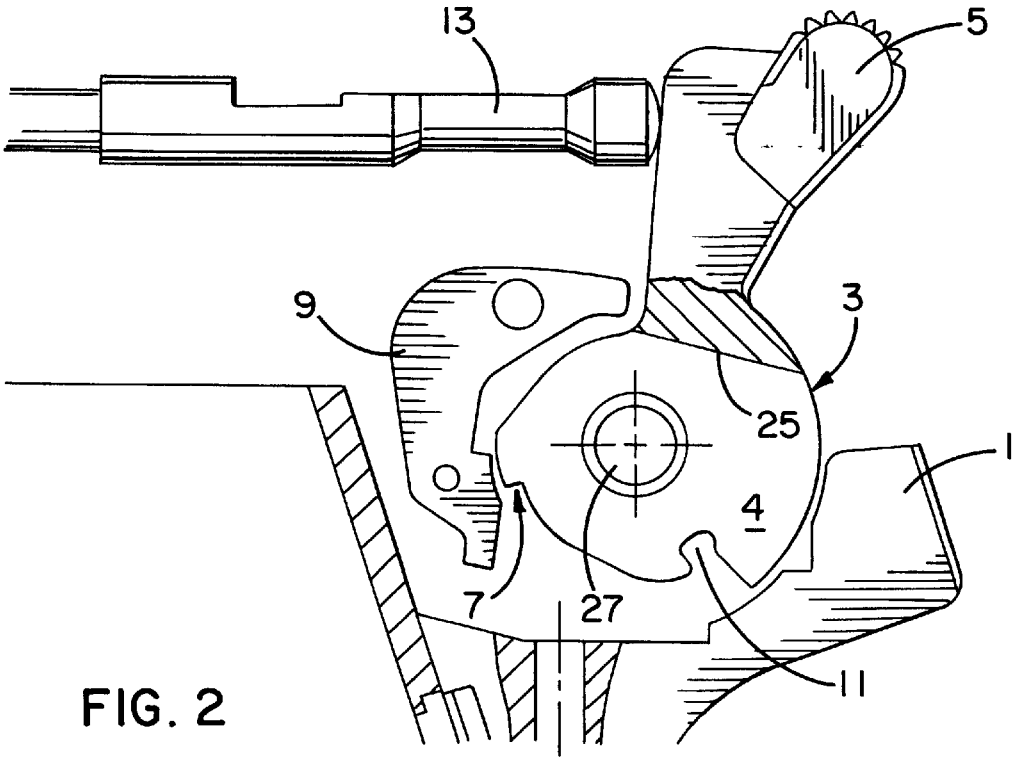
FIG. 2 is a view similar to FIG. 1, but showing the hammer element in its front end position with the safety lever released.

As shown in FIGS. 1 and 2, the hammer element 3 is provided with an upwardly protruding handle 5. The shooter can grasp the handle 5 with, for example, the thumb while holding the weapon. The hammer element 3 also includes a safety catch 7 and a coupling recess 11. The coupling recess 11 is utilized to connect the hammer element 3 to a conventional trigger (not shown) of the weapon by conventional intermediate elements (also not shown).

To selectively temporarily secure the hammer element 3 in the rest position, the cocking trigger mechanism is provided with a safety lever 9. The safety lever 9 is pivotably mounted on the pistol stock 1. In the rest position of the hammer element 3 (FIG. 1), the safety catch 7 of the hammer element 3 falls into engagement with a detent formed by the safety lever 9 to prevent further counterclockwise pivoting of the hammer element 3.

As shown in FIG. 2, the rear end of a firing pin 13 is situated in front of the handle 5 of the hammer element 3. The firing pin is located such that the hammer element 3 does not contact the pin 13 when the hammer element 3 is in its rest position. Of course, the hammer element 3 strikes the pin 13 when it enters its front position (FIG. 2).

The drive part 17, which is arranged within the recess of the hammer element 3, is rotatably mounted on the axis 27. The drive part 17 is loaded in a counterclockwise direction by a spring rod 15 that is pressed upward by a conventional striker spring (not shown). The drive part 17 also has a catch or a catch step 19 which engages a catch detent formed on a safety lever 21 when the drive part 17 is in its cocked position.

The safety levers 9, 21 are both connected to the trigger (not shown) so that the levers 9, 21 are swiveled out of respective engagement with the hammer element 3 and the drive part 17 when the trigger is pulled. A conventional interrupter (not shown) ensures that, after firing, the two levers 9, 21 are returned to their initial positions even if the user does not release the trigger and the drive part 17 is recocked as a result of a reloading process. In their initial positions, the levers 9, 21 prevent counterclockwise pivoting of the hammer element 3 and the drive part 17.

As shown in FIG. 1, when the hammer element 3 is in its rest position, the safety lever 9 engages the safety catch 7 and prevents further forward movement of the hammer element 3. Therefore, the hammer element 3 cannot reach the firing pin 13. The trigger spring (not shown) of this weapon acts via coupling 11 on the hammer element 3 and forces it forward. It is possible to pivot the hammer element 3 rearward by means of the handle 5, because the safety lever 9 and catch 7 only prevent a swivel movement toward the firing pin 13, not away from it. Because of the biasing force applied by the trigger spring, the hammer element 3 always returns to the rest position depicted in FIG. 1 when the handle 5 is released.

If the trigger is pulled, then the safety lever 9 is swiveled out of engagement with the safety catch 7. As a result, the hammer element 3 can reach the firing pin 13 (FIG. 2) and the pistol can fire a shot.

If the drive part 17 is pivoted rearward against the force exerted by the spring rod 15, then catch 19 falls into engagement with the catch lever 21 thereby securing the drive part 17 in the cocked position. If the trigger is pulled, then the hammer element 3 is pivoted rearwardly and the levers 9, 21 are pivoted together clockwise. The drive part 17 is, thus, released. The drive part 17 is then driven vigorously forward about axis 27 by the force of the spring rod 15. As the drive part 17 pivots from its cocked position to its uncocked position, it entrains the hammer element 3 because the support surface 23 of the drive part 17 strikes the countersurface 25 of hammer element 3. The hammer element 3 is, therefore, pushed vigorously forward (FIG. 5) until it strikes the firing pin 13 (i.e., until it enters its front position). The hammer element 3 can strike the pin 13 because, as already mentioned, the safety lever 9 was pivoted back by the pulled trigger.

When the shot is fired, the recoil acts via a conventional breech (not shown) on the handle 5 of the hammer element 3. As a result of this force, the hammer element 3 pivots back about the axis 27. The countersurface 25 presses against the support surface 23 of drive part 17 as the hammer element 3 rotates such that the drive part 17 is driven back into its cocked position. Upon reaching the cocked position, the catch 19 falls into engagement with the catch lever 21 and the drive part 17 is, therefore, held in the cocked position. When the breech returns to its forward position, the hammer element 3, which is driven by the trigger spring via coupling 11 with limited force, falls gently forward again until the safety catch 7 engages the safety lever 9 and the hammer element 3 is again secured against counterclockwise movement in the rest position.

Although, during the recoiling process described above, the trigger remains in the pulled state, it is decoupled from the levers 9, 21 by means of a conventional interrupter mechanism. As a result, the levers 9, 21 behave as if the trigger was not activated and return to their initial states immediately after firing where they secure the hammer element 3 and the drive part 17 as described above.

The normal use position of the trigger mechanism is shown in FIG. 6. If the trigger is now pulled, the hammer element 3 is initially moved rearward until the levers 9 and 21 are pivoted and the above described retraction (i.e., counterclockwise rotation) can occur. The condition right before retraction is shown in FIG. 7.

Figure 5:
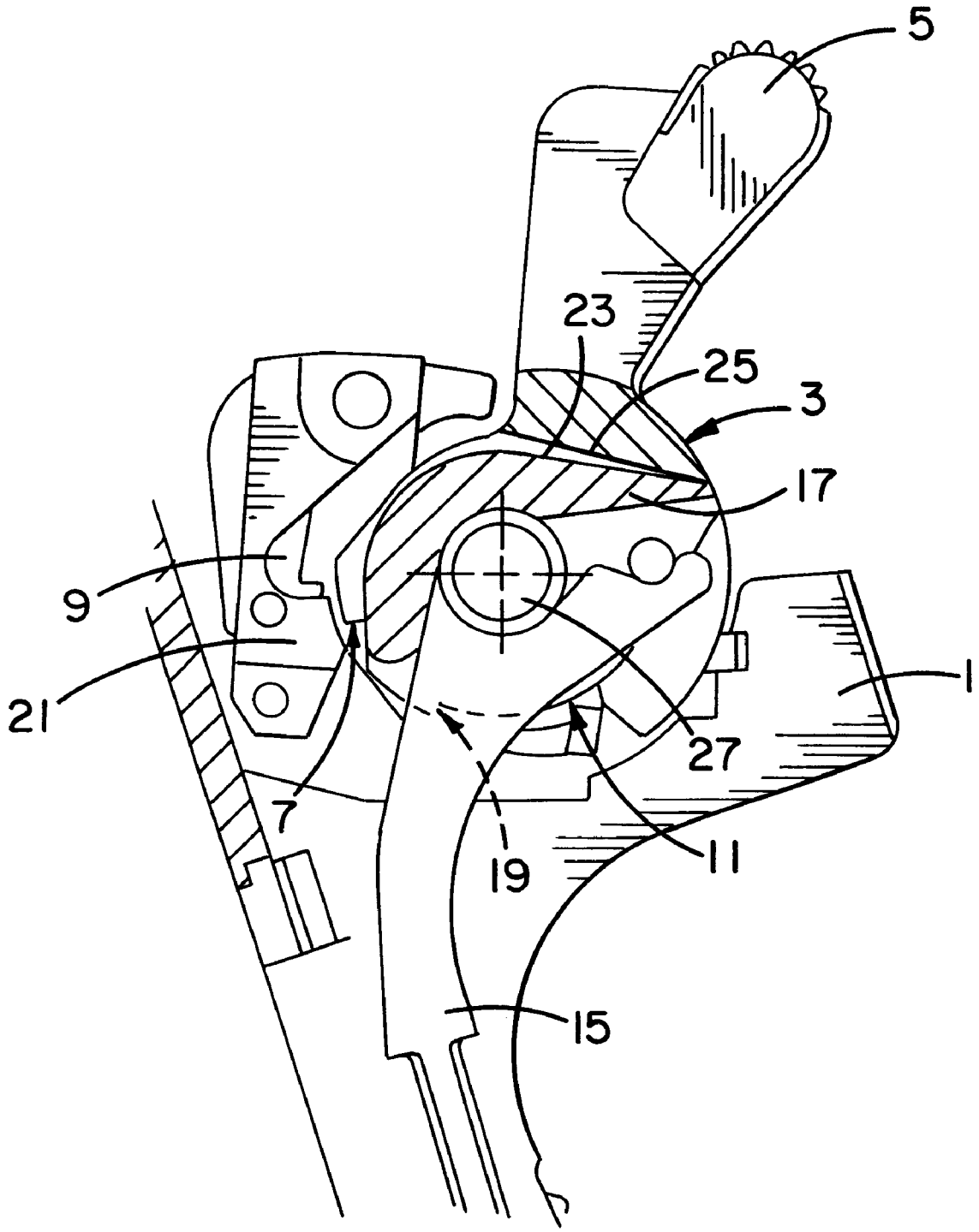
FIG. 5 is a view similar to FIG. 1, but showing the hammer element in the position of FIG. 2 and the drive part in the position of FIG. 4.

If after firing a shot no ignition of the cartridge occurs, the trigger mechanism remains in the position shown in FIG. 5 (i.e., with the hammer element 3 in the front position and the drive part 17 in the uncocked position). If the trigger is now released and subsequently pulled back, the hammer element 3 will pivot rearwardly as described above. However, as during the automatic reloading process described above, the hammer element 3 now carries the drive part 17 rearward. During subsequent pulling of the trigger, the drive part 17 is released and the trigger mechanism retracts again (i.e., rotates counterclockwise from the position shown in FIG. 7 to the position shown in FIG. 5 and, in the event of a fired shot, recoils to the position shown in FIG. 6).

For firing exercises in which no cartridge, an empty cartridge casing or a blank cartridge is situated in the cartridge magazine of the barrel, it is possible after each retraction to release the trigger and then manually pivot the hammer element 3 rearward by means of the handle 5. The hammer element 3 then carries the drive part 17 with it until the drive part 17 enters the cocked position. If the hammer element 3 is then released, it snaps forward until its safety catch 7 abuts against the safety lever 9. The trigger can then be pulled again to "fire" another shot.

In the embodiment shown in FIG. 6, the cocking trigger mechanism is provided with a trigger rod 29. The trigger rod 29 meshes with a protrusion in the recess (coupling) 11 of the hammer element 3. Thus, the trigger rod 29 pivots the hammer element 3 rearwardly into the position shown in FIG. 7 when the trigger is pulled. The trigger rod 29 also engages the safety lever 21. It thus releases the cocked drive part 17 for the lever 21 in order to allow the drive part 17 to retract under the influence of the spring rod 15.

Preferably, there is sufficient play between the hammer element 3 and the trigger rod 29 so that, when the hammer element 3 is pivoted rearward by hand into the position shown in FIG. 7, the drive part 17 is not triggered and the safety levers 9, 21 are not disengaged. Thus, the mechanism can be cocked by hand but preferably can only be fired by pulling the trigger.

In an alternative embodiment, however, the trigger rod 29 tightly engages with the protrusion in the recess 11 of the hammer element 3. In this alternative, the trigger rod 29 also operates the safety lever 21 when the hammer element 3 has assumed the position of FIG. 7. The individual relative positions of the elements of the trigger mechanism are then arranged so that the cocked drive part 17, which is released when the hammer element 3 is pulled back, can fall into engagement with the hammer element 3 with a distinct click. If the hammer element 3 is then allowed to move forward or simply released without touching the trigger, the hammer element 3 will then move under the load of the drive part 17 until the safety catch 7 of the hammer element 3 strikes the safety lever 9. The firing pin 13 is then not touched.

The hammer element 3, thus, serves as a mechanism for releasing the drive part 17 from its cocked position. Under this approach, however, the drive part cannot be cocked by means of the hammer element, but only by means of a separately provided cocking trigger.

From the foregoing, persons of ordinary skill in the art will appreciate that an improved trigger mechanism which eliminates at least some of the shortcomings of the prior art has been disclosed. The disclosed pistol is simple, safe and reliable to handle.

From the foregoing, persons of ordinary skill in the art will also appreciate that the hammer element 3 is connected to a return spring that forces it into a rest position situated at or near its front position as long as the trigger is not activated. The return spring always returns the hammer element 3 to its rest position, after it has been moved by an outside effect (e.g., by recoil forces generated from firing a shot or by applying a force to the handle 5). A "fully cocked position" in which the hammer element 3 remains pointed backward upon removal of the external force that moved the element 3 is not possible. The hammer element 3, therefore, does not require a handle 5 that protrudes rearward from the weapon, since it does not form a required operating element of the weapon. It is even possible to locate the hammer element 3 in the interior of the weapon or to cover it with a panel so that it cannot catch on any object, (for example, when the weapon is drawn).

The return spring that biases the hammer element 3 into its rest position also acts against the trigger. As a result, the force of this return/trigger spring must be overcome by the trigger during each shot.

Persons of ordinary skill in the art will further appreciate that, in the disclosed pistol, the "increased readiness position" is constantly present (with functioning munition) and acts as the primary mode of operation. In the event of cartridge failure, a cocking trigger can be used to reposition the trigger mechanism in the increased readiness state. If the weapon is provided with a retraction device that can uncock the drive part, the weapon can also be carried fully uncocked and operated with the cocking trigger during the first shot.

The force of the return spring and, thus, the trigger force that must be overcome before each shot can be optimized over broad limits according to the purpose of the weapon. Optionally, these forces may even be designed adjustable. The return spring of the disclosed pistol also acts in a direction that corresponds to that of the tension spring of the trigger mechanism of the aforementioned patents, (i.e., it forces the hammer element forward).

Persons of ordinary skill in the art will, thus, appreciate that the disclosed cocking trigger mechanism makes it possible to combine the advantages of the cocking trigger and simple design of the generic mechanism with the adjustable trigger weight and simple operation of the mechanism disclosed in one of the aforementioned patents without having to tolerate their shortcomings.

A pistol equipped with the disclosed trigger mechanism is naturally equipped with known safety devices that secure the firing pin as long as the trigger is not operating. For example, if the known pistol mentioned at the outset falls in the uncocked state from significant height with the hammer element onto pavement, a shot must not be fired. This hazard does not exist when the hammer element is located on the inside of the weapon.

Advantageously, in the disclosed mechanism, the drive part 17 sits on a stop in its uncocked position (at least when the trigger is not operated) and is thereby kept in a position in which it does not touch the striker 3 when it is situated in its rest position.

As described above, the hammer element 3 is accelerated by the drive part 17. However, the drive part 17 is detained at the end of the acceleration phase by the stop, whereas the hammer element 3 continues to move toward the firing pin 13 and strikes it because of the kinetic energy which was imparted to it by the drive part 17. The rest position of the hammer element 3 is situated on the other side of the stop so that the retracting drive part 17 cannot strike the hammer element 3 in the rest position, because it is detained beforehand on the stop. Thus, should the cocked drive part 17 be released for any reason without the trigger having been pulled when the hammer element 3 is in its rest position, the drive part 17 cannot reach the hammer element 3 and a shot cannot be unintentionally fired.

As another safety measure, when the hammer element 3 is in its rest position, its safety catch 7 engages the safety lever 9. Thus, the hammer element 3 cannot move beyond the lever 9 into its front position and, thus, cannot reach the firing pin 13. If either the drive part 17 strikes the hammer element 3 or the hammer element 3 is struck from the outside (perhaps if the weapon falls when the hammer element 3 is in its rest position), the engagement of the safety lever 9 secures the hammer element 3 so that no shot can be fired. Even if the hammer element 3 is moved rearward against the biasing action of the return spring and then released, the hammer element 3 merely pivots back into its rest position. The force of the return spring is selected to be insufficient to ignite a cartridge should an impact on the firing pin under the sole influence of the return spring occur.

It is also possible to align the effect of the return spring to the hammer element 3 so that the hammer 3 element assumes a dead center position in the rest position, like the cock of a return spring lock. The dead center position coincides with the position in which the safety lever 9 engages the safety catch 7. If the drive part 17 is cocked and the trigger not operated, then the hammer element 3 is automatically returned into its rest position in which the safety catch 7 is active, should it be situated in its frontmost position.

Persons of ordinary skill in the art will appreciate that the return spring that keeps the hammer element 3 in its rest position can be an independent tension or compression spring mounted between the hammer element and the weapon housing. However, in the preferred embodiment, the return spring is formed from the trigger spring or acts as a spring that continuously forces the trigger forward. Either a spring that acts directly on the hammer element 3 which in turn forces the trigger forward because of its connection to it, or a spring connected to the trigger that forces it forward, as is common, is therefore present. The trigger in turn acts, perhaps via a rod, on the hammer element 3 and brings it into a position connected to it.

Persons of ordinary skill in the art will appreciate that it is even possible to integrate a safety release in the trigger which blocks the trigger as long as the finger operating the trigger does not press down the safety release. Such a safety release can be arranged on the front surface of the trigger. Under such an approach, the hammer element 3 remains fixed in its rest position as long as the trigger is not operated. Even an external force applied to the hammer element 3 cannot move it from its rest position.

A weapon equipped with the disclosed cocking trigger mechanism can have additional devices that are known from other weapons. For example, a known retraction device to uncock the drive part 17 can be provided in the weapon. The drive part 17 can be moved to its uncocked position by means of this retraction device. If firing is to occur in this uncocked state, then the cocking trigger can be initially operated. If the hammer element 3 has a handle 5, however, it is also possible to grip the handle 5 of the hammer element 3, for example, with the thumb, and to move the hammer element 3 and, thus, the drive part 17 to the rear until the drive part 17 locks into the cocked position. The hammer element 3 is then allowed to move forward again, and the weapon is in its increased firing readiness state.

As already mentioned, the hammer element 3 is coupled to the trigger so that pulling of the trigger causes a pivoting movement of the hammer element 3 that can entrain the uncocked drive part, (for example, after a cartridge failure). This coupling between the hammer element 3 and the drive part 17 is preferably effected by means of a trigger rod 29. Trigger rod 29 is also coupled to the lever 21 so that, during operation of the trigger and, thus, the trigger rod, the cocked drive part 17 is released.

In the ordinary configuration the trigger rod 29 is, however, only fully coupled to the hammer element 3 in the cocking direction. If the hammer element is moved back by hand, the trigger rod 29 only partially follows the movement of the hammer element 3 so that the catch 19 of the drive part 17 can engage the corresponding lever 21. If the drive part 17 is uncocked for any reason, it can thus be recocked via manual movement of the hammer element 3.

Alternatively, the trigger rod 29 can be continuously coupled to the hammer element 3 free of play so that each position of the hammer element 3 is coordinated with a corresponding position of the trigger mechanism and vice versa. A recess 11 is provided for this purpose in the hammer element 3 into which a projection formed on the trigger rod 29 engages, (i.e., a hole is provided in the hammer element 3 into which a pin of the trigger rod 29 engages), or the like.

If the hammer element 3 is moved rearward by means of its handle 5 while the drive part 17 is cocked, then the trigger rod 29 is moved simultaneously until the catch 19 of the drive part 17 is released from the lever 21. In this case, the operating positions of all elements are adjusted so that the drive part 17 is moved slightly forward after release and then falls into engagement with the hammer element. This process is perceptible by a distinct audible click. If the handle 5 is released or allowed to move slowly forward with the thumb, the hammer element 3 moves forward together with the drive part 17 until the safety lever 9 detains the hammer element before it reaches the firing pin 13. However, the safety lever 9 is only active if the trigger is not pulled. This modification, thus, acts as a retraction mechanism. Pursuant to this modification, it is not possible to cock the drive part 17 by operating the hammer element 3. When the drive part 17 is retracted, the first shot occurs by means of the cocking trigger mechanism. If the locking lever 21 and the safety lever 9 are retracted by operating the trigger and the drive part 17 (together with the hammer element 3) and released, then the connection between the trigger and the trigger rod 29 is released so that the trigger rod 29 can move together with the hammer element 3 without the trigger also having to be moved.

Although certain instantiations of the teachings of the invention have been described herein, the scope of coverage of this patent is not limited thereto. On the contrary, this patent covers all instantiations of the teachings of the invention fairly failing within the scope of the appended claims either literally or under the doctrine of equivalents.

What is claimed is:

1. For use with a firearm, a cocking trigger mechanism comprising:

a hammer element having a front position, a rear position, and a rest position, the rest position being disposed between the front position and the rear position, the hammer element being movable between the front position and the rear position and being adapted to strike an object to fire a shot when it enters the front position;

a drive part having an uncocked position and a cocked position, the drive part being moveable between the uncocked and cocked positions and being located to entrain the hammer element when it moves from the cocked position to the uncocked position;

a striker spring biasing the drive part towards the uncocked position;

a trigger in operative engagement with the hammer element for moving the hammer element towards its rear position, wherein, if the drive part is in the uncocked position when the hammer element is moved, the hammer element moves the drive part against the force of the striker spring towards the cocked position;

a return spring biasing the hammer element towards the rest position whereby the hammer element assumes the rest position in the absence of a counteracting force being applied thereto; and a first safety lever for operatively engaging the drive part to temporarily secure the drive part in the cocked position when the drive part is moved from the uncocked position to the cocked position independently of the trigger.

2. A cocking trigger mechanism as defined in claim 1 wherein the object to be struck by the hammer element comprises a firing pin.

3. A cocking trigger mechanism as defined in claim 1 wherein the object to be struck by the hammer element comprises an ignition area of a cartridge.

4. A cocking trigger mechanism as defined in claim 1 wherein the rest position is a default position of the hammer element.

5. A cocking trigger mechanism as defined in claim 1 wherein, unless the trigger is operated, when the hammer element is released from the rear position, it returns to the rest position without entering the front position.

6. A cocking trigger mechanism as defined in claim 1 wherein the drive part is separated from the hammer element when the drive part is in the cocked position and the hammer element is in the rest position.

7. A cocking trigger mechanism as defined in claim 1 further comprising a second safety lever which operatively engages the hammer element to define the rest position.

8. A cocking trigger mechanism as defined in claim 7 wherein, unless the trigger is operated, the second safety lever prevents the hammer element from entering the front position.

9. A cocking trigger mechanism as defined in claim 7 wherein the hammer element includes a safety catch which cooperates with a detent formed by the second safety lever to secure the hammer element in the rest position.

10. A cocking trigger mechanism as defined in claim 7 wherein the second safety lever is operatively coupled to the trigger so that operation of the trigger moves the second safety lever to permit the hammer element to enter the front position.

11. A cocking lever mechanism as defined in claim 7 wherein the second safety lever has a first position in which it prevents the hammer element from entering the front position and a second position wherein the hammer element can enter the front position, the second safety lever being operatively coupled to the trigger such that operation of the trigger moves the second safety lever from the first position to the second position.

12. A cocking trigger mechanism as defined in claim 1 wherein the return spring comprises a trigger spring and pulling the trigger moves the hammer element toward the rear position.

13. A cocking trigger mechanism as defined in claim 1 wherein the first safety lever is operatively coupled to the trigger such that movement of the trigger disengages the first safety lever from the drive part to permit movement of the drive part from the cocked position to the uncocked position under the force of the striker spring.

14. A cocking trigger mechanism as defined in claim 1 further comprising a trigger rod in operative engagement with the hammer element and the first safety lever.

15. A cocking trigger mechanism as defined in claim 14 wherein the trigger rod is disposed to release the drive part from the second safety lever when the hammer element enters the rear position.

16. A cocking trigger mechanism as defined in claim 14 wherein the trigger rod is disposed to move the drive part into the cocked position when the hammer element is moved towards the rear position.

17. A cocking trigger mechanism as defined in claim 14 wherein the hammer element defines a recess, and the trigger rod is disposed within the recess such that each position of the trigger rod is coordinated with a corresponding position of the hammer element.

18. A cocking trigger mechanism as defined in claim 1 wherein the hammer element includes a handle for facilitating manual movement of the hammer element towards the rest position.

19. A cocking trigger mechanism as defined in claim 1 wherein the hammer element is completely disposed within a housing associated with the firearm to prevent contact therewith.

20. A cocking trigger mechanism as defined in claim 1 further comprising a stop positioned to prevent the drive part from contacting the hammer element when the hammer element is in the rest position and the trigger is in an unfired position.

21. A cocking trigger mechanism as defined in claim 20 wherein the stop comprises part of the first safety lever.

22. For use in a firearm, a cocking trigger mechanism comprising:

a hammer element disposed for movement between a front position, a rear position and a rest position;

a return spring biasing the hammer element into the rest position;

a drive part having an uncocked position and a cocked position, the drive part being located to entrain the hammer element when it moves from the cocked position to the uncocked position;

a striker spring biasing the drive part towards the uncocked position;

a first safety lever for operatively engaging the drive part to selectively temporarily secure the drive part in the cocked position;

a second safety lever for operatively engaging the hammer element to selectively temporarily secure the hammer element in the rest position; and a trigger in operative engagement with the hammer element for moving the hammer element towards its rear position, the cocking trigger mechanism having (1) a secured uncocked position wherein the hammer element is secured in one of the front and rest positions and the drive part is secured in the uncocked position, (2) a secured increased readiness position wherein the hammer element is secured in the rest position and the drive part is secured in the cocked position; and (3) an unsecured fully cocked position wherein the drive part is secured in the cocked position and the hammer element is temporarily secured in the rear position by application of an external force.

23. A cocking trigger mechanism as defined in claim 22 wherein the hammer element includes a handle and the external force is manually applied to the handle.

24. A cocking trigger mechanism as defined in claim 22 wherein the external force is manually applied to the hammer element via the trigger.

* * * * *